US005273078A

United States Patent [19]

Kimbara et al.

[11] Patent Number: 5,273,078

[45] Date of Patent: Dec. 28, 1993

[54] ROD-TYPE THREE-DIMENSIONAL LOOM AND CONTINUOUS OPERATING METHOD

[75] Inventors: Masahiko Kimbara; Michiya Hayashida, both of Tsukuba, Japan

[73] Assignee: Three-D Composites Research Corporation, Tsukuba, Japan

[21] Appl. No.: 904,567

[22] Filed: Jun. 26, 1992

[30] Foreign Application Priority Data

Jun. 28, 1991 [JP] Japan ..... 3-185751
Jul. 29, 1991 [JP] Japan ..... 3-211635

[51] Int. Cl.[5] ..... D03D 41/00

[52] U.S. Cl. ..... 139/11; 139/DIG. 1; 428/902; 428/109; 428/113; 428/119

[58] Field of Search ..... 139/11, DIG. 1, 384 R; 428/257, 225, 119, 902, 109, 113, 119

[56] References Cited

U.S. PATENT DOCUMENTS 5,076,330 12/1991 Kimbara et al. ..... 139/11

FOREIGN PATENT DOCUMENTS 0484541 4/1991 European Pat. Off. ..... 139/DIG. 1

112441 4/1990 Japan ..... 139/11

*Primary Examiner*—Andrew M. Falik

*Attorney, Agent, or Firm*—Oblon, Spivak, McClelland, Maier & Neustadt

[57] ABSTRACT

A rod-type three-dimensional weaving method and apparatus sends weft rods from within a rod magazine between groups of warp rods consisting of a large number of warp rods disposed parallel to one another by means of rod pushers substantially continuously by automatically changing a used-up magazine with another one filled with a new set of weft rod groups. To achieve such continuous weaving, a sensor senses a point where one of the rods in the magazine reaches the preset limit for a magazine change, and a control unit acting on the signal from the sensor removes the used-up magazine and brings another magazine filled with a new set of rod groups into the rod filling position. Or the same control unit stops the rod pushers on one side and starts feeding weft rods from the opposite side by employing the magazine and rod pushers on the opposite side of the group of warp rods, with a significant reduction in the weaving time.

7 Claims, 12 Drawing Sheets

ROD-TYPE THREE-DIMENSIONAL LOOM AND CONTINUOUS OPERATING METHOD

FIELD OF THE INVENTION

This invention relates to a rod-type three-dimensional loom with an automatically interchangeable magazine and a continuous operating method of the same.

DESCRIPTION OF THE PRIOR ART

U.S. Pat. No. 5,076,330 et al. disclose rod-type three-dimensional looms weaving rods of reinforced fibers bonded together with matrices. This type of loom holds a group of warp rods disposed parallel to one another, whereas each of two magazines holds a corresponding group of weft rods disposed in a plane. The weft rods successively discharged from the magazine are passed between the corresponding warp rods.

This type of three-dimensional loom can continue weaving while the magazines hold a sufficient number of weft rods in them. When all weft rods in either magazine run out, however, the operator must stop the loom to replace the empty magazine with another one. Still, the number of weft rods a magazine can hold is limited as a magazine packed with too many weft rods tends to cause trouble. Therefore, it has been necessary to constantly watch a decrease in the number of weft rods contained in each magazine.

For the solution of the above problem and the elimination of the need for constant watching, a mechanism to insure a more stable feeding of rods has been necessary.

SUMMARY OF THE INVENTION

A principal object of this invention is to provide a rod-type three-dimensional loom that can continue weaving substantially without interruption by automatically changing a used-up magazine with another one and a continuous operating method of the same loom.

Efficient weaving can be impracticable unless the need to watch for problems is reduced along with the need to watch for a decrease in the remaining rods in a magazine. Therefore, another object of this invention is to provide a mechanism that minimizes the problems associated with the insertion of weft rods and other steps of weaving operations to assure a more stable rod insertion and reduce the need for a worker to constantly watch the normal operating condition of a loom. Also, since the present invention provides for the automatic change of a used-up magazine with another one, an operator does not have to stop a loom to replace an empty magazine and restart the operation.

As described before, three-dimensional fabrics are woven by a rod-type three-dimensional loom that holds a group of warp rods disposed parallel to one another, and holds a corresponding group of weft rods disposed in a plane held in a magazine. A rod pusher successively sends the weft rods from the magazine between the corresponding warp rods. To achieve the above objects, the three-dimensional loom operating method of this invention comprises sensing a point where one of the rods in the magazine reaches the preset limit for a magazine change with a sensor, removing the used-up magazine by means of a control unit acting on the resulting signal from the sensor, and loading another magazine filled with a new multi-strand group of rods into the rod feeding position.

The operating method of this invention also comprises sensing a point where one of the rods in the magazine reaches the preset limit for a magazine change with a sensor, stopping the rod pushers by means of a control unit acting on the signal from the sensor, feeding weft rods from another magazine preset on the opposite side of the group of warp rods, and replacing the used-up magazine with one filled with a new set of weft rods while the feeding of weft rods from the opposite direction is being continued. During the feeding of weft rods from the opposite direction, removal of the used-up magazine, placement of another magazine filled with a new set of weft rod groups in the feeding position and replacement of the used-up magazine with the new one can be accomplished automatically through a control unit.

A three-dimensional continuous loom of this invention comprises a holder to hold a multi-strand group of warp rods disposed parallel to one another, rod magazines each holding a corresponding group of weft rods disposed in a plane and rod pushers to feed the weft rods successively from the magazine between the corresponding warp rods, plus a combination of a sensor to sense a point where one of the rods in the magazine reaches the preset limit for a magazine change, an unloader to remove a used-up magazine, a feeder to supply another magazine filled with a new set of weft rod groups, a magazine stand to move a magazine to the weft rod feeding position and the delivery position on the unloader and feeder, and a control unit to control the automatic replacement of magazines by the magazine stand, unloader and feeder on the signal from the sensor.

A rod-type three-dimensional loom of this invention also has, in addition to a set of rod feeders each comprising a rod magazine and rod pushers, another similar set of rod feeders on the opposite side of the group of warp rods, a sensor to sense a point where one of the rods in the magazine reaches the preset limit for a magazine change, and a control unit to stop the rod feeders in operation and start the rod feeders on the opposite side on the signal transmitted from the sensor.

A pressure plate may be provided in the rod magazine to push out each rod in the feeding direction and actuate the sensor when one of the rods reaches the preset limit for a magazine change.

In the rod-type three-dimensional loom of this invention just described, the sensor senses when one of the rods in the magazine reaches the preset limit for a magazine change where the magazine is thoroughly or nearly emptied and the control unit acts on the signal from the sensor to either replace a used-up magazine with another one filled with a new set of weft rod groups or start a spare set of rod feeders on the opposite side. This permits substantially continuous weaving without interrupting the operation of a loom even when any rod in the magazine is used-up. This also frees the operator from the troublesome and pressing job of magazine change and the need to continue constant watching for the use-up of rods.

DESCRIPTION OF THE PREFERRED EMBODIMENTS

A rod used for the three-dimensional weaving according to this invention is made up of a large number of fibers oriented in the same direction and bonded together with a matrix.

The rod-type three-dimensional weaving according to this invention is performed by passing a number of weft rods contained in rod magazines through a number of corresponding warp rods disposed parallel to one another. Each rod magazine holds a group of weft rods that are disposed side by side in a plane, put into the magazine from the open end thereof and passed between corresponding warp rods through guide grooves in the bottom plate of the magazine.

Figure 1:
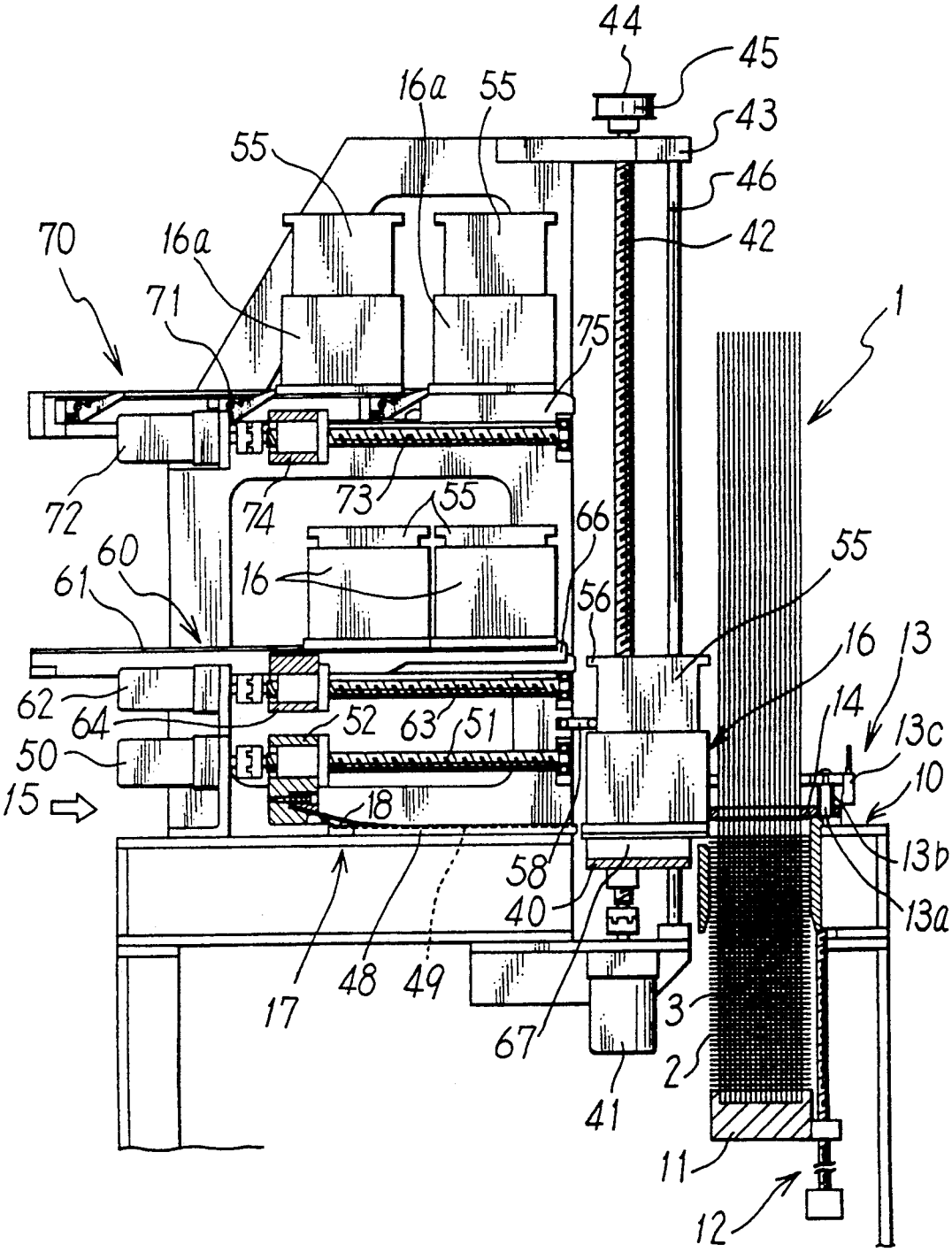
FIG. 1 is a cross-sectional side elevation of a rod-type three-dimensional three-axis loom according to this invention.
Figure 2:
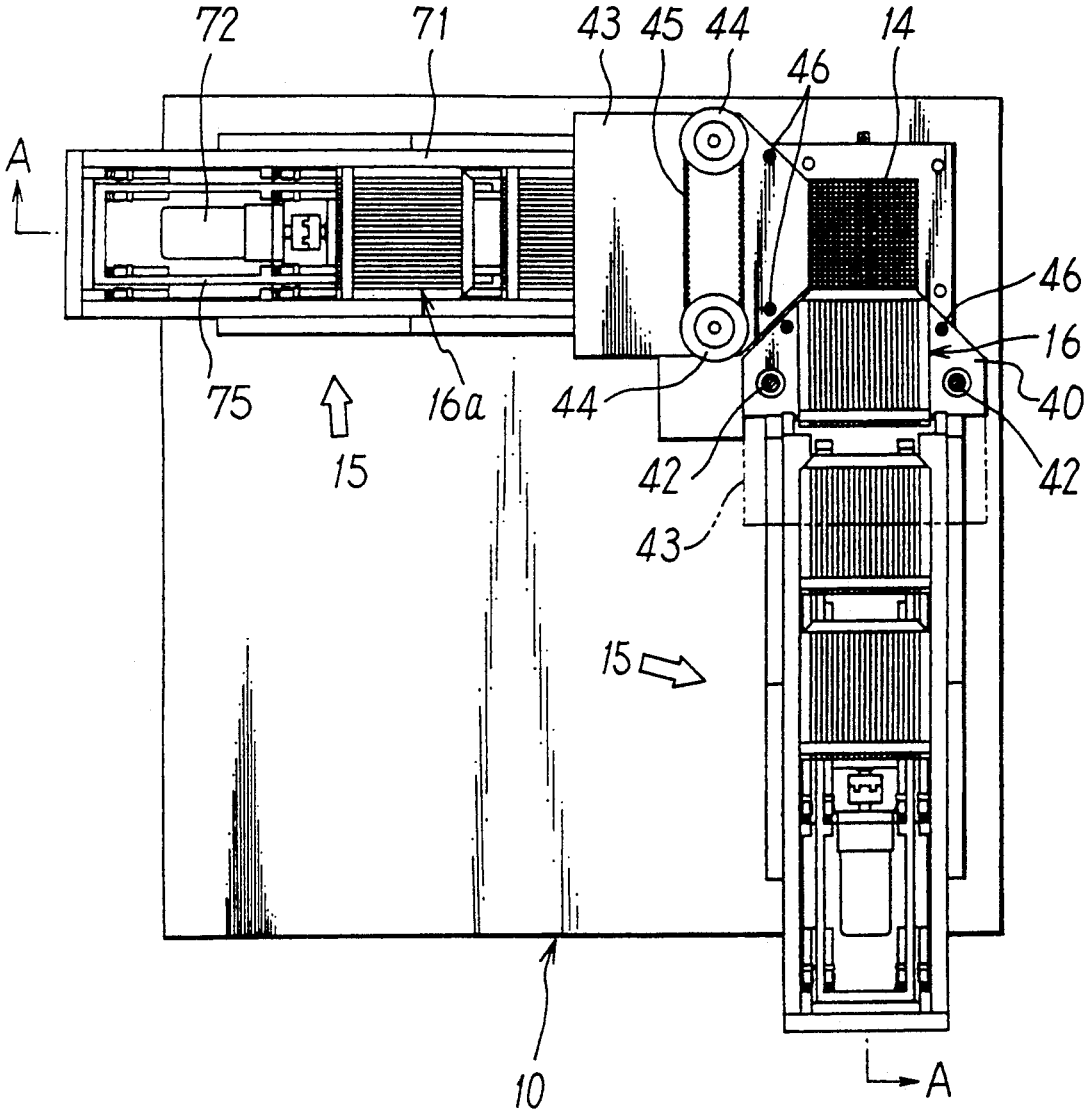
FIG. 2 is a plan view of the same loom.

A preferred embodiment of a loom to implement such three-dimensional weaving about three axes is shown in FIGS. 1 and 2. As illustrated, weft rods are passed from two perpendicularly intersecting directions between a group of warp rods disposed parallel to one another.

To perform this three-dimensional weaving, a loom frame 10 holds thereon a group of warp rods 1 disposed parallel to one another at given intervals. On the loom frame 10 is mounted an elevatable holder 11 that raises and lowers the group of warp rods 1 by means of a motor driven screw lift 12 that holds the lower end of the group of warp rods 1. The holder 11 holds the warp rods at such intervals that weft rods 2 can be passed therebetween to form a closely woven texture. A drive control unit lowers the holder 11 as the weaving operation proceeds. The holder 11 has a number of small holes disposed at given intervals to press in the tip of warp rods and chucks to keep the rods parallel to one another.

A reed plate 14 to space apart the warp rods is provided above the weaving point of the group of warp rods 1. The reed plate 14 comprises a reed having a number of guide holes to pass through the warp rods, thus spacing the warp rods evenly at a point where the weft rods 2 are passed therebetween.

Two weft rod feeders 15 to pass two groups of weft rods 2 between the group of warp rods 1 from two perpendicularly intersecting directions are provided at the filling point of the weft rods on the loom frame 10. Each of the weft rod feeders 15 has a rod magazine 16 to hold a number of weft rods 2 to be passed between the warp rods. Push rods 18 in a rod pusher 17 send the weft rods 2 supplied from within the magazine 16 between the warp rods 1.

After filling the weft rods 2, the lift 12 pushes up the holder 11 holding a three-dimensional fabric 3 being woven against the reed plate 14 held above the weaving point.

To sense the operating condition of the reed and keep stable spacing of the weft rods, a reed beating mechanism 13 is provided on the reed plate 14. The reed beating mechanism 13 comprises a reed beating sensor 13*c* (a contact-less switch) mounted on the loom frame 10 that senses the position of the reed plate 14 moving against the force of a reed actuating spring 13*b* that urges the reed plate 14, which moves up and down along a reed plate guide 13*a* erected on the loom frame 10, toward the three-dimensional fabric 3.

This sensor detects when the fabric being woven comes in contact with the reed plate 14. For example, a pressure sensor to sense the reed beating load or an abnormal current sensor to detect a change in the power of a reed actuating motor may be used in place of the position sensor 13*c* to detect the displacement of the reed plate 14.

As reed beating finishes when the value sensed by the reed beating sensor 13*c* reaches the desired level, beating is always performed with a steady force and even beating assures the production of homogeneous, highly packed three-dimensional fabrics. Besides, an even weft rod filling space is always obtained because the space to fill in the next weft rod is secured by spacing the three-dimensional fabric a given distance away from the reed plate on the basis of the position of the reed plate on completion of beating.

Figure 3:
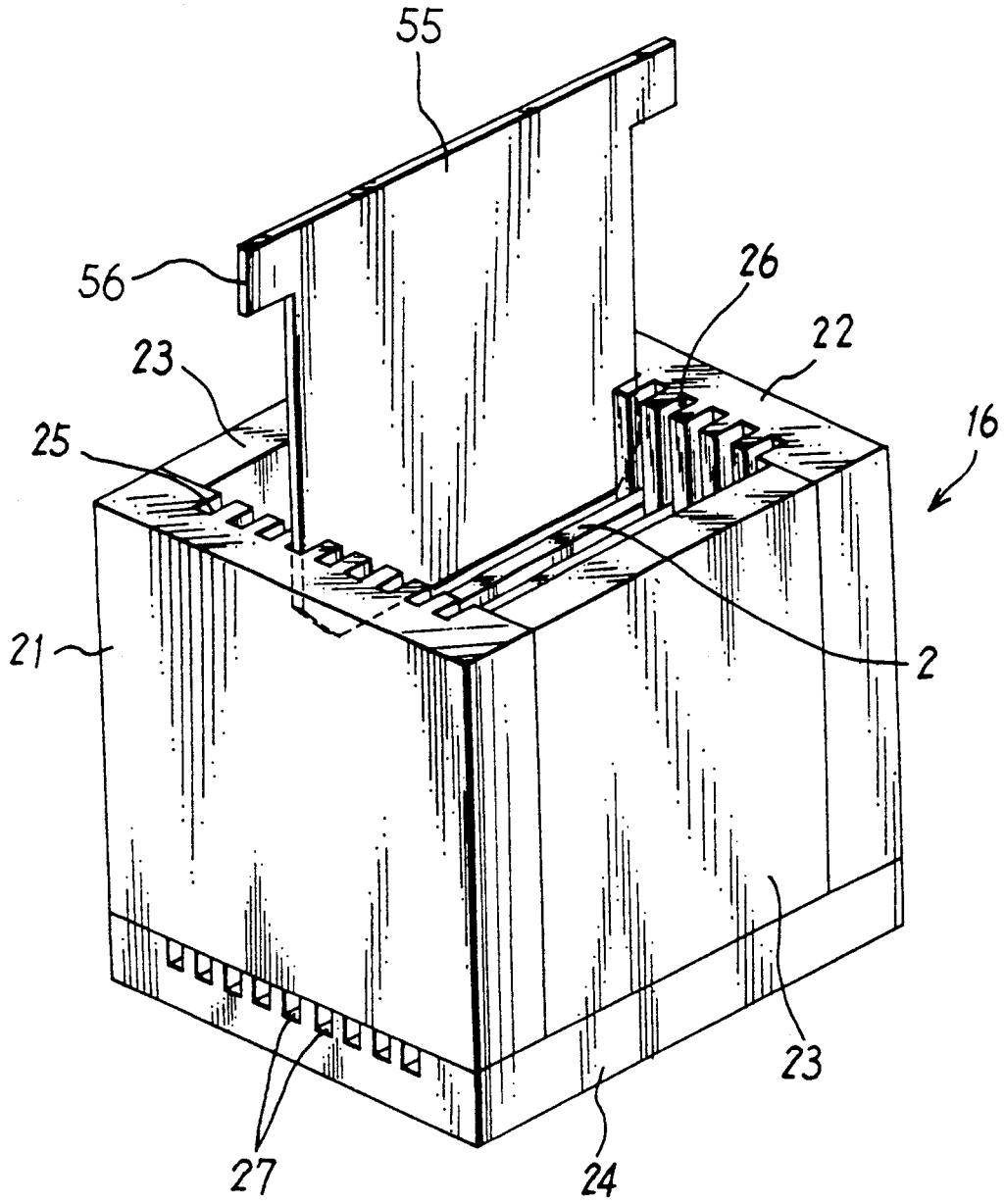
FIG. 3 is a perspective view of a rod magazine used on the same loom.

The rod magazine 16 holds the arranged weft rods 2 inside that are successively sent outside by the push rods 18 as weaving proceeds. As shown in FIG. 3, the magazine 16 is made up of a front plate 21, a rear plate 22, side plates 23, and a bottom plate 24 on which the lowest rods 2 in the rod groups rest. While grooves 25, 26 to guide both sides of the weft rods are provided on the inside of the front and rear plates 21, 22, rod feed grooves 27 are provided on the bottom plate 24. The number of the grooves 25, 26 must be at least large enough to accommodate one cycle supply of weft rods to be passed between the warp rods 1.

Thus, the weft rods 2 held between the grooves 25, 26 cut in the front and rear plates 21, 22 constitute a flat rod group and are sent into the rod feed grooves 27 in the bottom plate 24 of the magazine 16 one after another.

Figure 4:
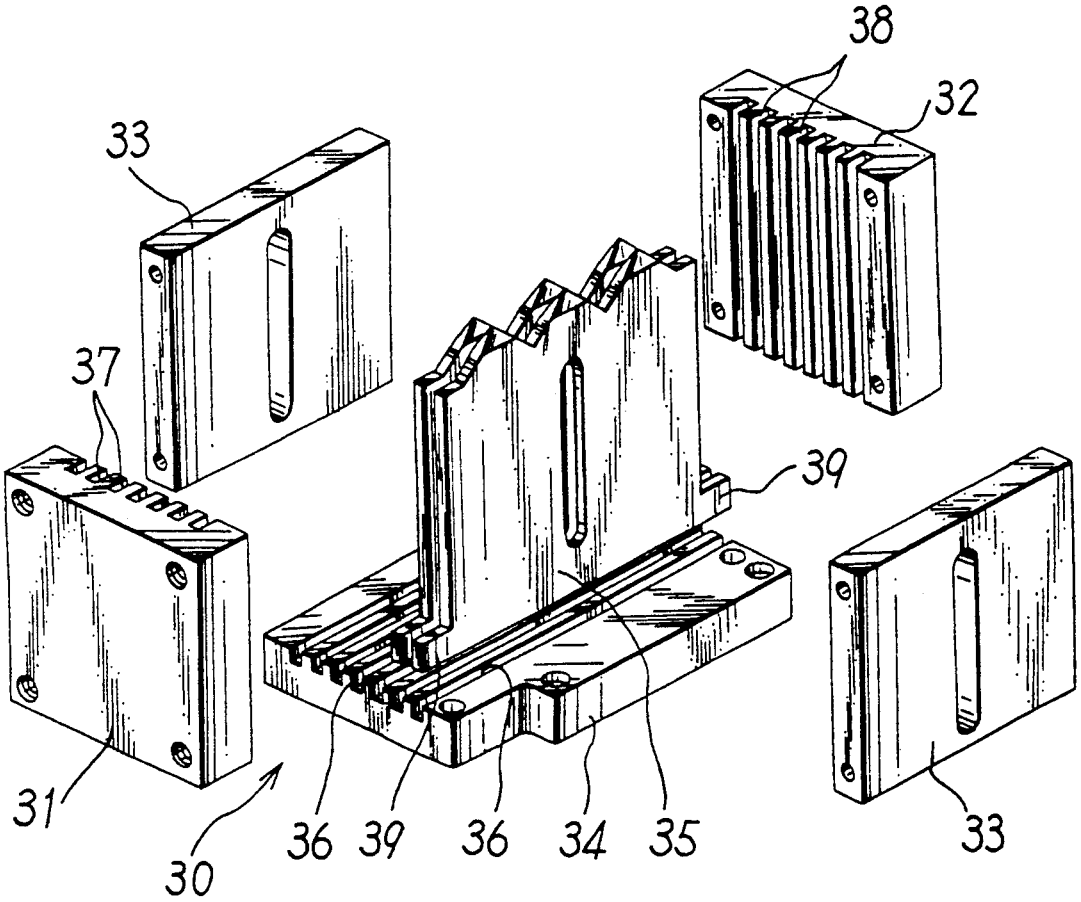
FIG. 4 ia an exploded perspective view of another example of a rod magazine.
Figure 5:
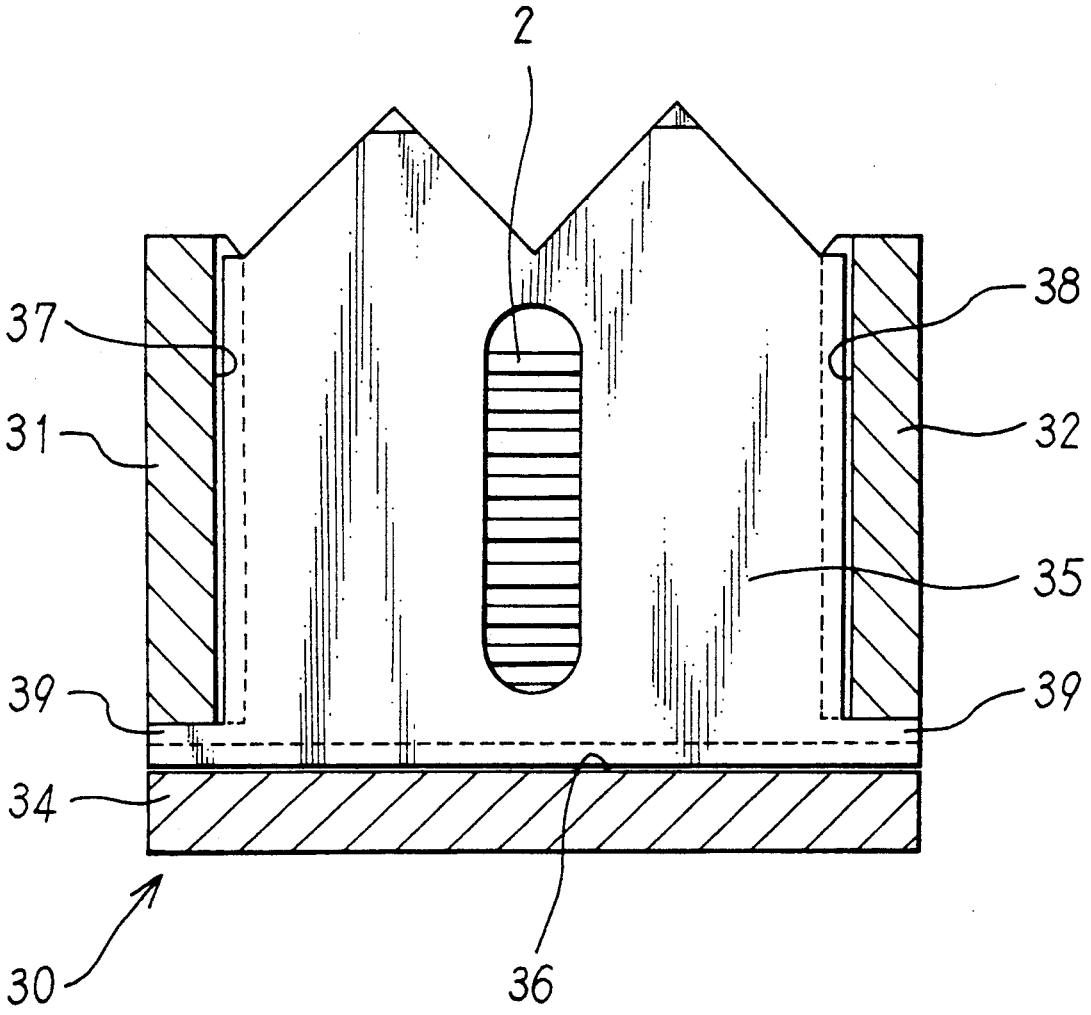
FIG. 5 is a cross-sectional view of the same rod magazine in an assembled condition.

FIG. 4 is an exploded view of another example of a rod magazine, and FIG. 5 shows the same rod magazine in an assembled state. This rod magazine 30 is composed of a front plate 31, a rear plate 32, side plates 33, a bottom plate 34 on which the lowest rods 2 of the rod groups contained therein rest, and partitions 35 to separate the individual groups of rods from one another.

The partitions 35 are fixed by fitting their lower end in grooves 36 cut in the bottom plate 34 and their sides in vertical grooves 37, 38 cut in the front and rear plates 31, 32, thus forming spaces to hold the groups of rods therebetween. Each partition 35 has a prop 39 at its front and rear ends that projects somewhat from the groove 36 in the bottom plate 34 to support the lower end of the front and rear plates. With the front and rear plates 31, 32 placed on the props 39, the lower end thereof is kept away from the top surface of the ridges between the grooves on the bottom plate to leave large enough spaces to accommodate the lowest weft rods 2 and the push rods 18 to push them out.

Thus, the top surface of the ridges between the grooves 36 on the bottom plate 34 guides the lowest weft rods. While the partitions 35 guide the sides of the rod groups held therebetween, the lower end of the front and rear plates 31, 32 guides the top surface of the rods 2 and the push rods 18. In combination, the ridges, partitions and front and rear plates provide a seamless guide for the group of rods held in the rod magazine.

The seamless guide in the magazine assures a smooth motion of each weft rod, first downward into the filling position and then sideward on being pressed by the push rod 18.

The following paragraphs describe the use of the magazine 16, which is identical with the use of the magazine 30.

The rod magazine 16 is either placed or fastened, using a simple fastening device, on an elevatable magazine stand 40 that is moved up and down by a pair of feed screws 42 driven by a motor 41 on the loom frame 10 as shown in FIGS. 1 and 2. A support 43 integral with the loom frame 10 supports the upper end of the paired feed screws 42. Pulleys 44 are fastened to projections on the support 43, with a timing belt 45 passed thereover to cause the paired feed screws 42 to rotate interlockingly.

Reference numeral 46 designates a guide rod to guide the upward and downward motion of the magazine stand 40.

Figure 6:
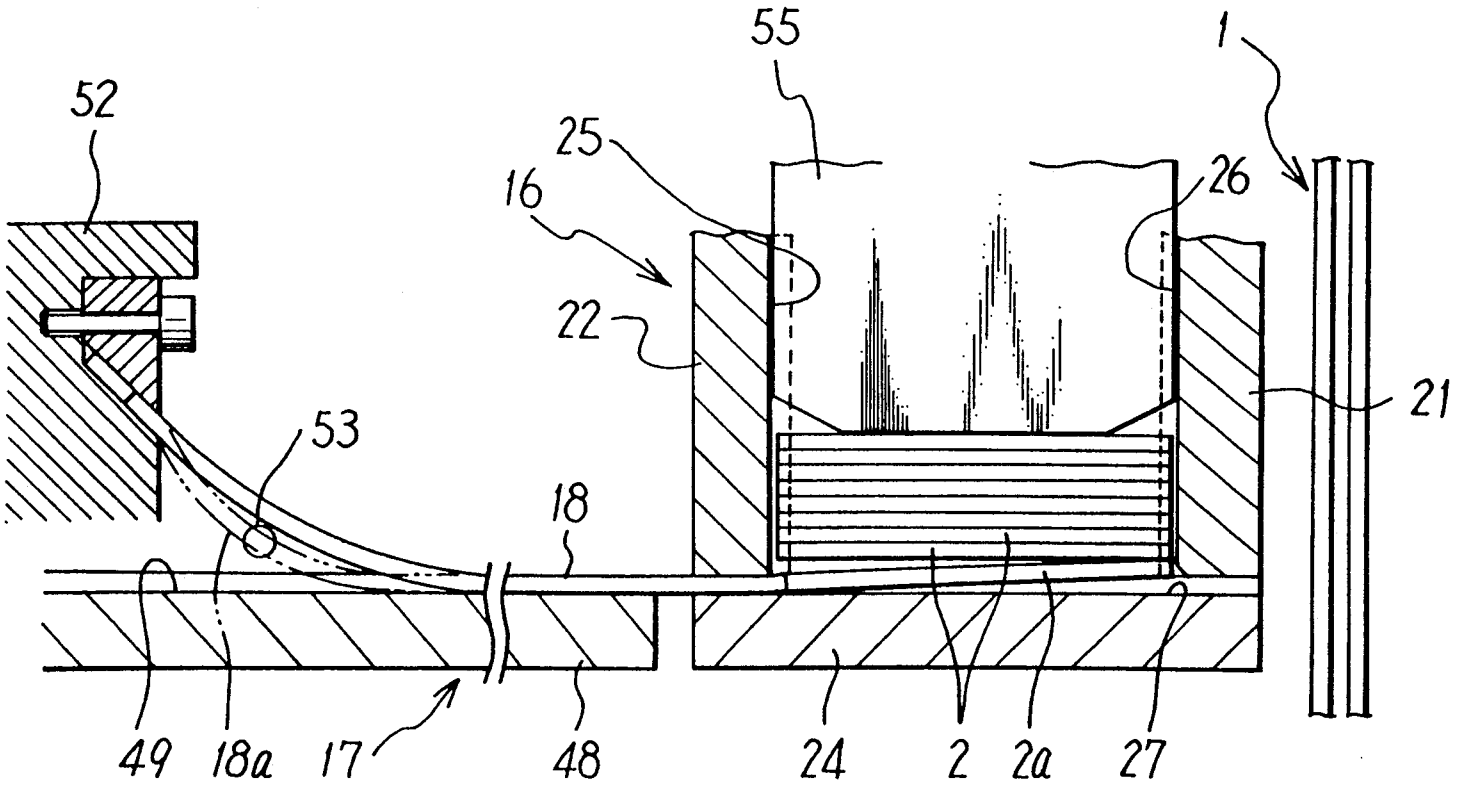
FIG. 6 is a cross-sectional side elevation enlarging the principal parts of a rod pusher.

To fill in the weft rods 2 by means of the rod pusher 17, the bottom plate 24 of the magazine 16 has many parallel rod feed grooves 27 to accommodate the weft rods 2 (see FIG. 3). The loom frame 10 carries a push rod guide 48 that extends flush with the bottom plate 24 of the magazine 16 placed in the rod filling position on the magazine stand 40. The push rod guide 48 has a large number of push rod guide grooves 49 communicating with the rod feed grooves 27. As is obvious from a detail view in FIG. 6, a drive unit on the loom frame 10 moves the push rods 18 in the guide grooves 49 back and forth along the guide grooves 49 and the rod feed grooves 27. The drive unit moves a drive member 52 screwed on a threaded rod 51 rotated by a motor 50, as shown in FIG. 1. The elastic push rods 18 diagonally curved upward from within the guide grooves 49 are attached to the drive member 52.

Fitting the push rods 18 in the guide grooves 49 inhibits the buckling thereof as their buckling in other directions than upward, in which direction the push rods 18 leave the guide grooves 49, is prevented while their deformation is limited in the direction in which the guide grooves 49 extend. The base end of the push rods are curved away from the rod guide grooves and gripped by the drive member 52. Thus, the curved push rods are gripped more easily and firmly than the straight push rods contained in the grooves.

Furthermore, the part of the push rods 18 close to the base end thereof and led outside the guide grooves 49 gets out of normal place if trouble results from the insertion of the weft rods 2. When, for example, the leading end of the weft rods 2 gets blocked by the front plate 21 of the magazine 16, the insertion of the weft rods 2*a* by the push rods 18 is prevented, and the curved portion of the push rods 18 makes an abnormal move, moving closer to the guide grooves 49, before buckling. Therefore, a sensor 53 to sense the abnormal displacement of the push rods 18 outside the guide grooves 49 is provided at the base end of the push rods 18. The sensor 53 detects an insertion trouble by sensing the abnormal displacement of the push rods 18 indicated by a dot-dash line (18*a*) in FIG. 6. When required, the three-dimensional loom can be stopped on the signal from the sensor.

Various types of sensors can be used as the sensor 53 to sense the abnormal displacement of the push rods 18, such as an infrared beam sensor, a contactless sensor to sense the approach of the rod, and a sensor with a lever moved by the displacement of the rod. When the sensor detects an insertion trouble, the loom operation can be stopped without running an unwanted danger.

To push out the weft rods 2 from the rod magazine 16 placed in the rod feeding position on the loom frame 10, the leading end of the push rods 18 is positioned opposite to the base end of the weft rods 2 in the rod feed grooves 27 of the rod magazine 16. To assure this positioning, the paired feed screws 42 keep the magazine stand 40 at an appropriate level. The rod magazine 16 is placed so that the weft rods 2 in the rod feed grooves 27 are positioned in proper relationship with filling spaces between the warp rods. When pushed out by the push rods 18, accordingly, the lowest wept rods 2 of the rod groups contained in the magazine 16 move into the corresponding spaces between the warp rods.

A pressure plate 55 that serves as a weight to press the weft rod outward is mounted on each rod group contained in the rod magazine 16, as partially shown in FIG. 3. The pressure plate 55 shown in FIG. 3 is inserted between a pair of facing grooves 25, 26. Though not shown, the pressure plate 55 rests on a group of weft rods placed in position. Also, the pressure plate 55 can be inserted between the partitions 35 that separate the individual rod groups away from one another in the rod magazine 30, as shown in FIGS. 4 and 5.

The pressure plate 55 has a sensor trigger 56 that projects outward on both sides of the top end thereof. On top of the loom frame 10 is provided a residual rod sensor 58 that is actuated when the descending sensor trigger 56 comes in contact. The residual rod sensor 58 and the sensor trigger 56 of the pressure plate 55 are positioned with respect to each other so that the sensor trigger 56 descends and comes in contact with and thereby actuates the sensor 58 on the loom frame 10 when the residual rod in the rod magazine 16 reaches the preset limit for a magazine change (i.e. when the rod magazine 16 is either thoroughly or nearly emptied).

The number of sensors 58 provided is equal to that of rod groups contained in the magazine 16, and the sensors 58 are connected to a control unit not shown. Provision is made, with a spring or other device, to make the sensor retractable so as not to interfere with the up-down travel of the magazine. The control unit transmits a signal to replace a used-up magazine with a new one when one of the sensors 58 senses that the residual rod in the rod group it covers has reached the limit for a magazine change.

The replacement of a magazine 16 is accomplished by ejecting a used-up magazine 16 to a discharge guide from the delivery point and bringing a new magazine filled with a new set of rod groups into the rod feeding position.

An ejector 60 to remove a used-up magazine from the top of the magazine stand 40 is provided on the loom frame 10 at a point halfway in the vertical stroke of the magazine stand 40. As is obvious from FIG. 1, the ejector 60 has a discharge guide 61 on the loom frame 10 and a threaded rod 63 driven by a motor 62 below the discharge guide 61. A moving element 64 moving along the threaded rod 63 is screwed thereover, and a hooked rod 65 fastened to the moving element 64. The hooked rod 65 has a hook 66 to engage with the magazine 16 at the tip thereof that is adapted to pass through a groove 67 provided in the top surface of the magazine stand 40.

As will be described later by reference to FIGS. 9 and 10, a used-up magazine 16 is lifted to the magazine delivery point. After passing the hooked rod 65 through the groove 67 in the top surface of the magazine stand 40 and projecting the hook 66 beyond the magazine 16, the magazine stand 40 is lowered somewhat to bring the hook 66 into engagement with the bottom plate 24 of the magazine 16. Under this condition, the motors 41 and 62 are controlled to pull out the hooked rod 65 from the groove 67 on the magazine stand 40. Then, the magazine 16 is removed from the magazine stand 40 onto the magazine discharge guide 61.

Figure 7:
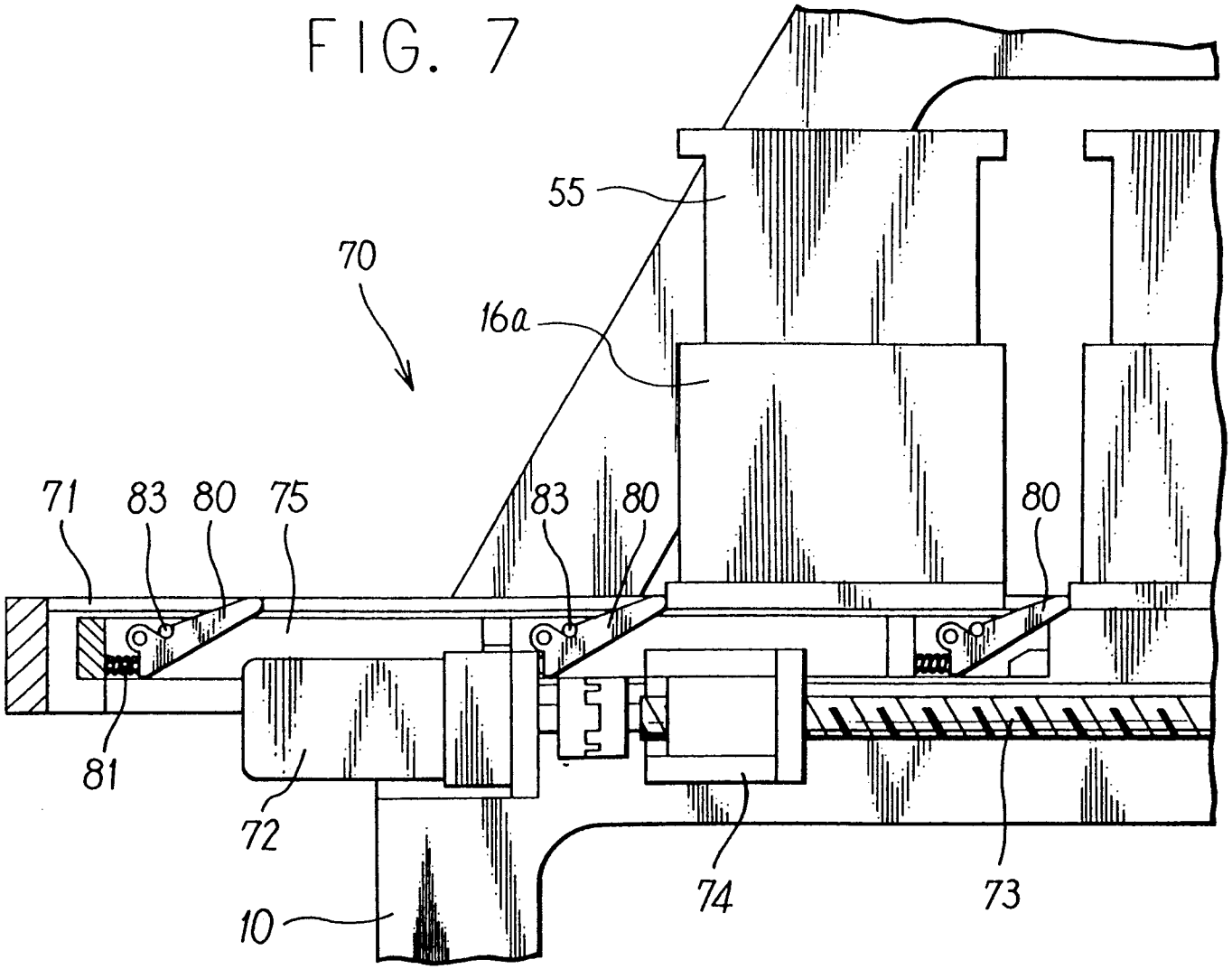
FIG. 7 is a cross-sectional side elevation enlarging the principal parts of a rod magazine feeder.
Figure 8:
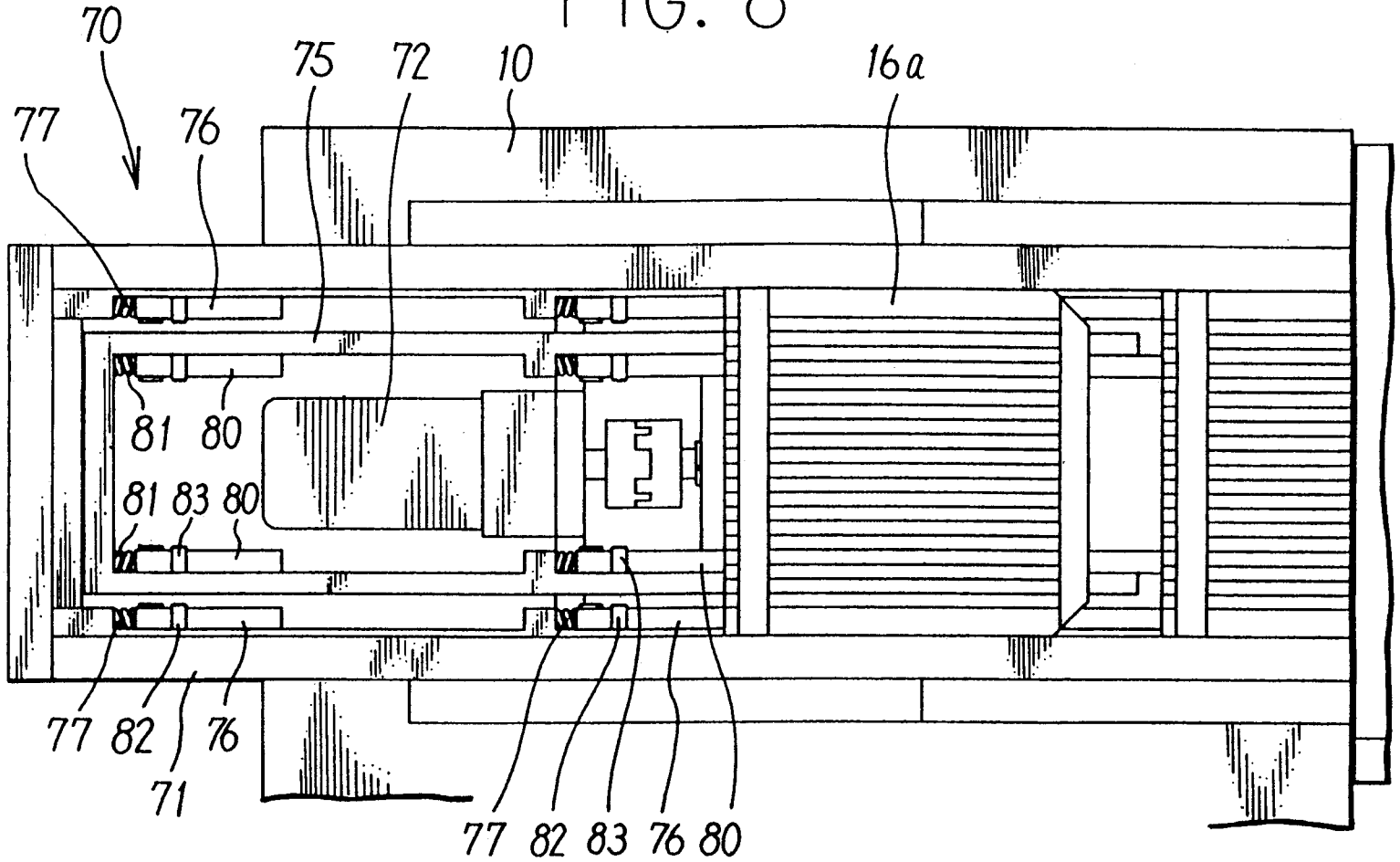
FIG. 8 is a plan view of the same rod magazine feeder.

A magazine feeder 70 to feed a magazine 16a filled with a new set of rod groups onto the magazine stand 40 is provided at the upper end of the stroke thereof on the loom frame 10, as shown in FIGS. 7 and 8.

The magazine feeder 70 has a magazine feed guide 71 on the loom frame 10, with a threaded rod 73 driven by a motor 72 provided therebelow. A moving element 74 moving along the threaded rod 73 is screwed thereover, with a sliding frame 75 fastened to the moving element 74.

A pawl 76 to allow the magazine 16a to move over the feed guide 71 in the feeding direction only is provided thereon. A spring 77 causes the pawl 76 to project above the feed guide 71. A one-way feed catch 80 projected above the feed guide 71 by a spring 81 is provided on the sliding frame 75. The one-way feed catch 80 engages with the magazine 16a on the guide 61 when the sliding frame 75 moves in the feeding direction and moves the magazine in that direction. During the return stroke of the sliding frame 75, the catch 80 retracts to below the magazine 16a without engaging therewith, against the urging force of the spring 81. Reference numeral 82 designates a stopper of the pawl 76, and 83 a stopper of the one-way feed catch 80.

In the three-dimensional loom just described, a group of warp rods is held on the loom frame 10. The rod pusher 17 sends the weft rods 2 from within the rod magazine 16 containing a group of weft rods into between the warp rods held in position. When this process is repeated, one of the rod groups in the rod magazine 16 is used up and reaches the limit for a magazine change. Then, the used-up magazine is replaced with another magazine containing a new set of rod groups as shown at A to D in FIGS. 9 and 10.

Figure 9A:
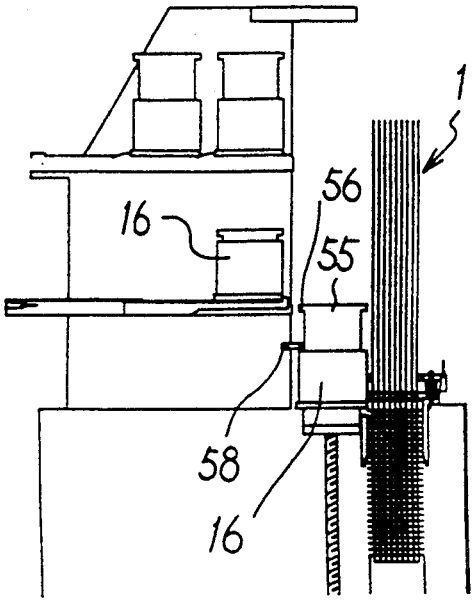
FIGS. 9A to 9D show the steps of continuous operation of the three-dimensional loom of this invention.
Figure 9B:
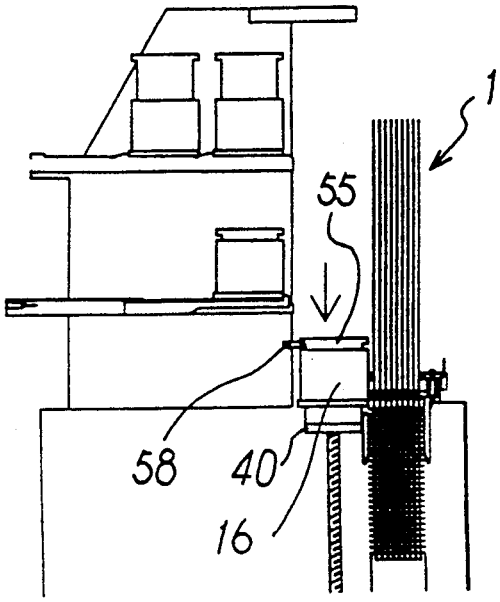

To be more specific, the filling of weft rods is repeated at FIG. 9A. One of the rod groups is used up and reaches the limit for a magazine change at FIG. 9B. Then, the descending sensor trigger 56 of the pressure plate 55 actuates the residual rod sensor 58, whereupon the control unit starts replacing the used-up magazine 16 with a new one on the signal transmitted from the sensor 58.

Figure 9C:
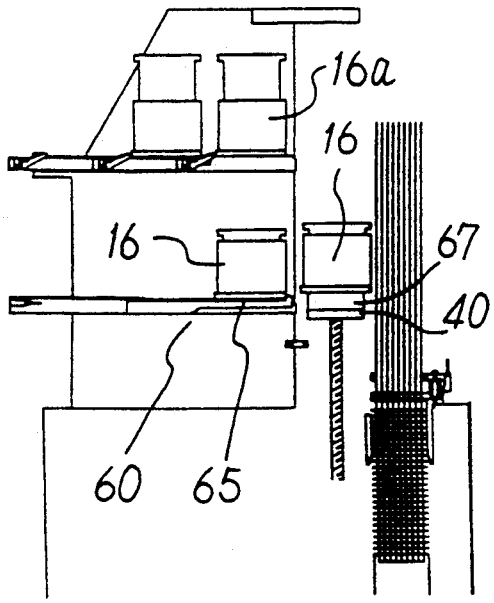
Figure 9D:
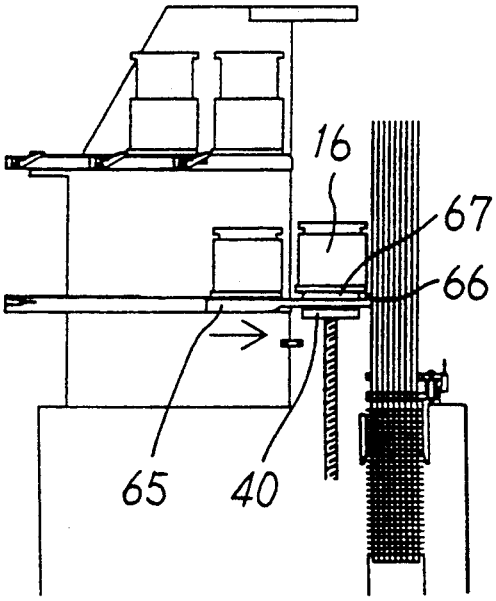
Figure 10A:
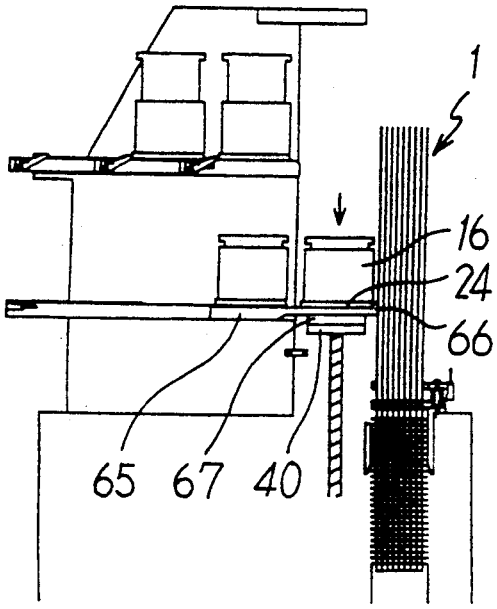
FIGS. 10A to 10D show the subsequent steps of continuous operation of the three-dimensional loom of this invention.
Figure 10B:
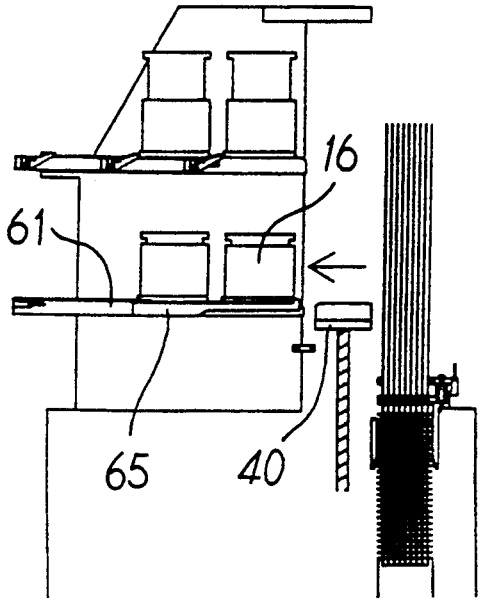

On the drive signal from the control unit, the motor-driven magazine stand 40 moves up to the magazine delivery point midway in the stroke, as shown at FIG. 9C. The ejector 60 then removes the used-up magazine 16 from the magazine stand 40. The motor 62 drives the threaded rod 63, thereby inserting the hooked rod 65 into the groove 67 in the top surface of the magazine stand 40 until the hook 66 at the tip thereof sticks out on the opposite side of the magazine 16, as shown at FIG. 9D. Then, the motor-driven magazine stand 40 is lowered somewhat to bring the hook 66 into engagement with the bottom plate 24 of the magazine 16, as shown at FIG. 10A. The hooked rod 65 is then pulled out from the groove 67 to move the magazine caught by the hook 66. Thus, the magazine 16 moves from the top of the magazine stand 40 onto the magazine discharge guide 61.

Figure 10C:
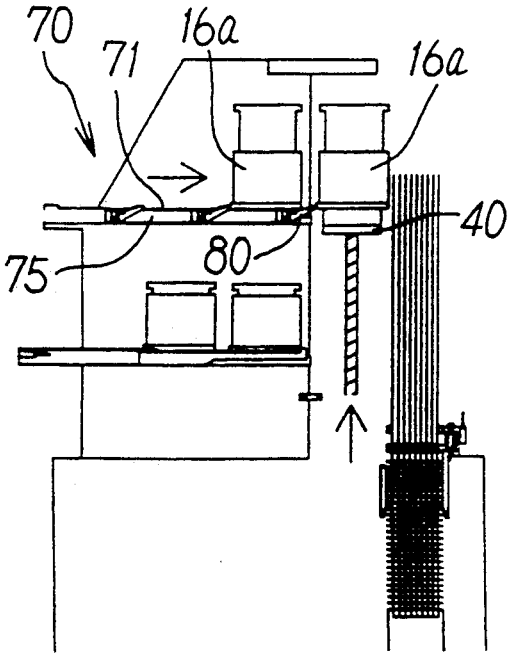
Figure 10D:
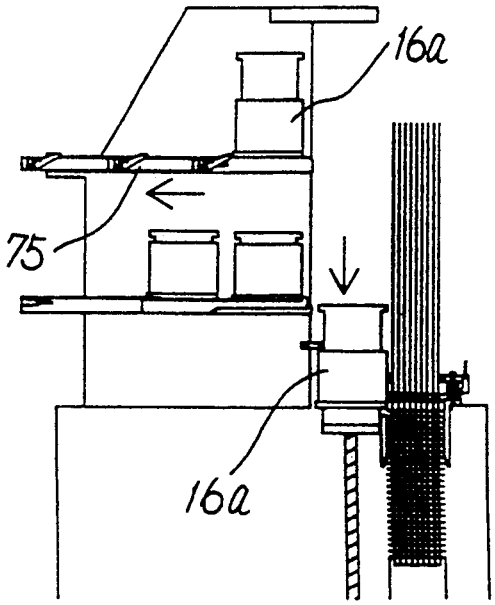

A magazine 16a filled with a new set of rod groups is placed on the magazine feed guide 71 on the magazine feeder 70, as shown at FIG. 10C. The magazine feeder 70 feeds the magazine 16a onto the magazine stand 40. To be more specific, the magazine stand 40 is lifted to the meeting point with the feed guide 71. Then, the motor-driven threaded rod 73 of the magazine feeder 70 moves the sliding frame 75 toward the magazine stand 40. The magazine 16a is then pushed out along the feed guide 71 by the one-way feed catch 80 on the sliding frame 75 that is engaged therewith. Then, the sliding frame 75 retracts as shown at FIG. 10D. At the same time, the contracting spring 81 withdraws the one-way feed catch 80. As the pawl 76 engages with the magazine 16a to prevents the withdrawal thereof, a new magazine 16a is fed onto the magazine stand 40 each time the sliding frame 75 reciprocates The magazine stand 40 is lowered to the rod filling point after a new magazine 16a has been placed thereon.

It is preferable that a magazine change is completed while the three-dimensional fabric 3 moves up and down to permit the beating of the weft rods 2 filled between the warp rods 1. Even beyond that span of time, the magazine change time can be reduced sufficiently.

The mechanism to move magazines for replacement is by no means limited to the one described above. Other appropriate means to eject a used-up magazine and bring another magazine filled with a new set of rod groups into the rod filling position can be used as well.

Figure 11:
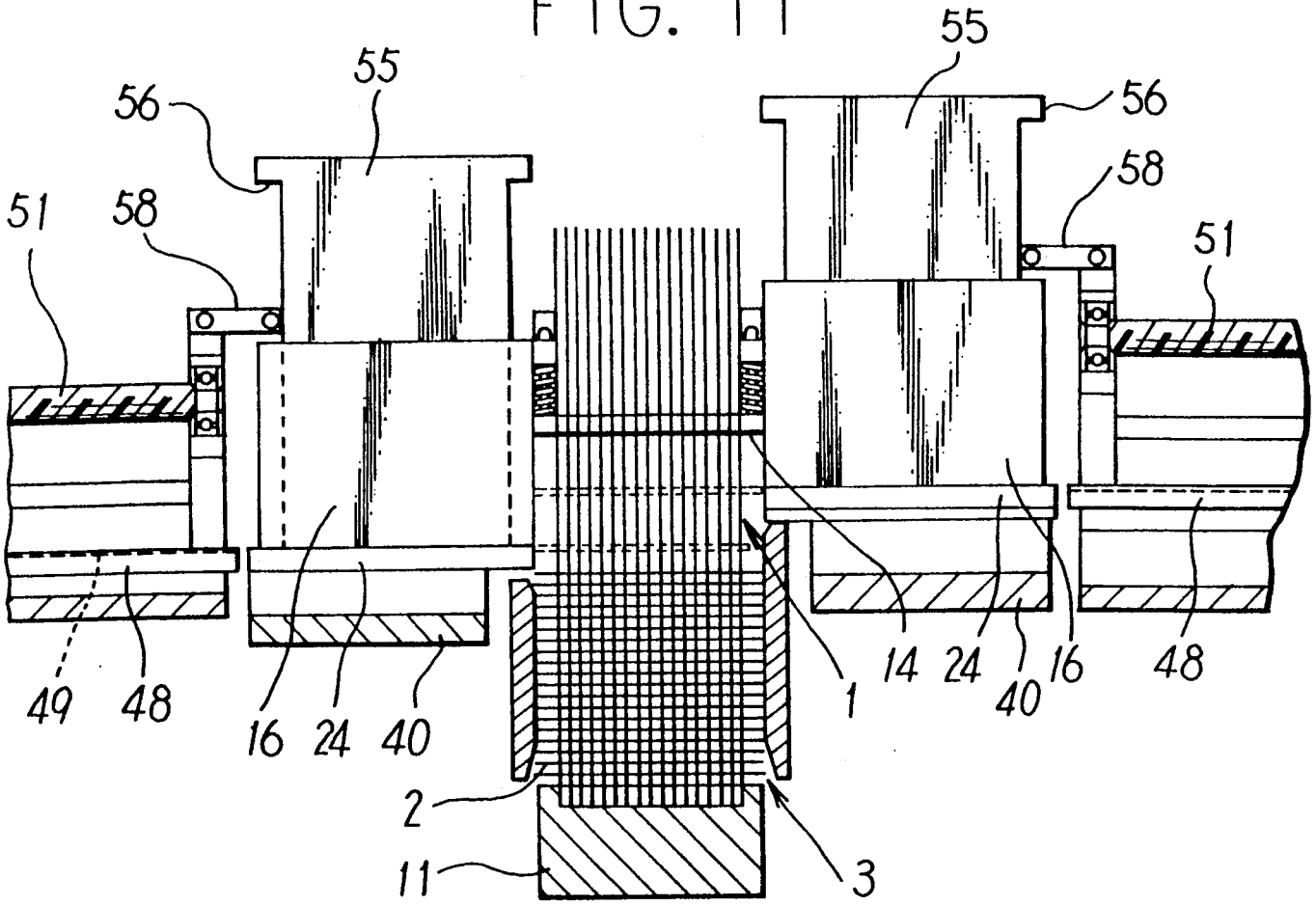
FIG. 11 is a cross-sectional view of the principal parts of the loom in FIG. 2 taken along the line A—A therein.

FIG. 11 is a cross-sectional view of the principal parts of the loom in FIG. 2 taken along the line A—A therein. In the preferred embodiment shown in FIG. 2, weft rods are passed between warp rods from two perpendicularly intersecting directions. If the inserting point of the weft rods in the individual rod feeders 15 is shifted toward the weaving direction to such an extent that no interference occurs between the individual rods and the rod filling timings of the rod feeders are controlled by a drive control unit, the rod filling time in each cycle is drastically reduced, with a resulting improvement in the weaving efficiency of three-dimensional fabrics. The control by the drive control unit should preferably be programmed to prevent the interference of rods between individual rod feeders, as can be achieved, for example, by completing the filling of all rods when the rod filling from all rod feeders is complete.

The required number of weft rod feeders are provided in the desired positions to weave three-dimensional multi-axis fabrics by filling a large number of weft rods from two or more different directions.

Figure 12:
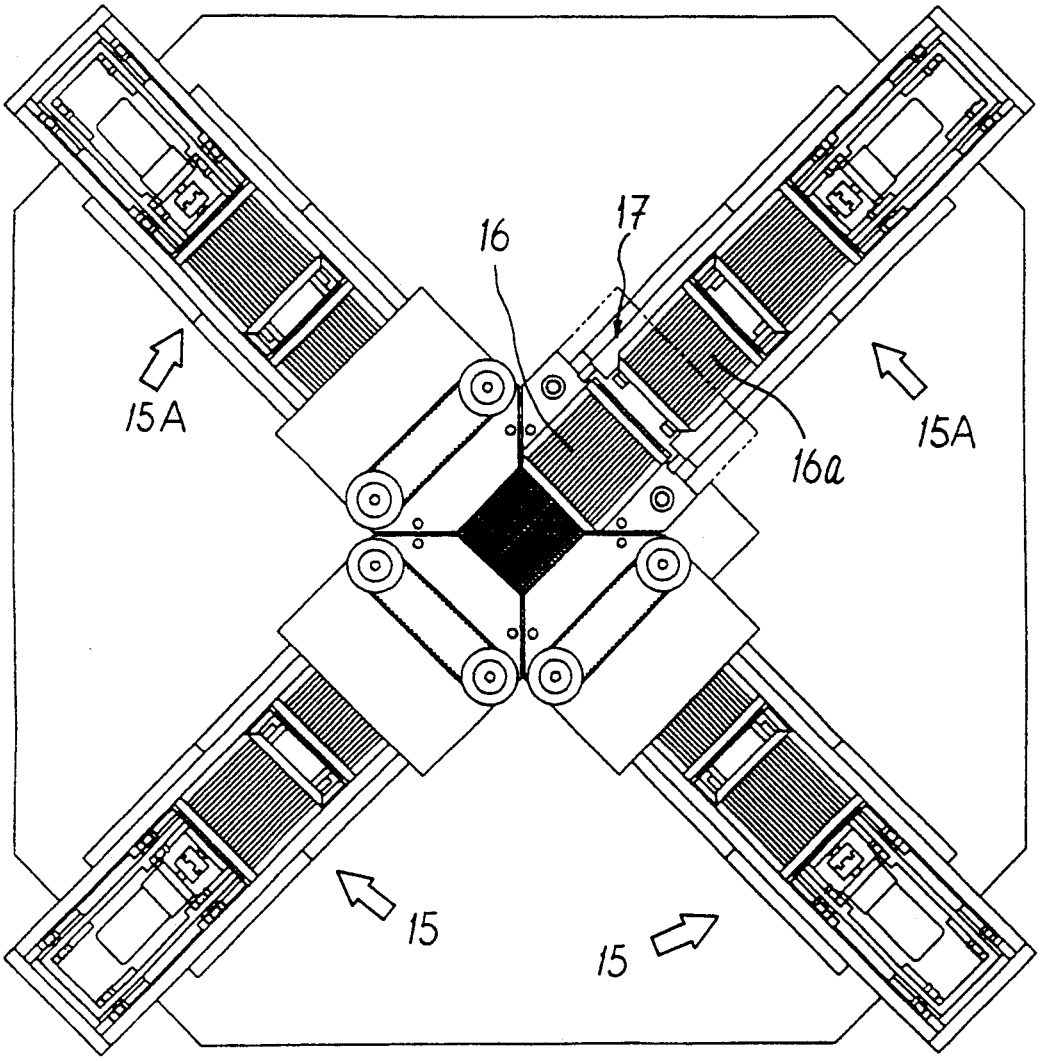
FIG. 12 is a plan view of another embodiment of this invention.

FIG. 12 shows a preferred embodiment comprising a pair of weft rod feeders 15 each comprising a rod magazine 16 and a rod pusher 17 and another opposite pair of spare rod feeders 15A of similar construction disposed on the opposite side of a group of warp rods 1.

Like the preferred embodiment described before, this three-dimensional loom also has sensors to sense when the rods in the rod magazine reaches the preset limit for a magazine change. However, the control unit functions differently, stopping the rod feeders 15 on the signal from the sensor and switching to rod filling from the spare rod feeders 15A on the opposite side.

The used-up magazine is changed with another magazine filled with a new set of rod groups while rod filling from the spare rod feeders 15A is being continued. This magazine change is accomplished automatically by the mechanism described before, but it may also be achieved manually when an appropriate alarm is generated as the provision of the spare rod feeders allows sufficient time for the change.

Though the preferred embodiments described above relate to the weaving of three-dimensional three-axis fabrics, the method and apparatus of this invention are also applicable to the weaving of three dimensional fabrics with four or more axes in which weft rods are filled into a group of warp rods from more than two different directions.

What is claimed is:

1. A continuous rod-type three-dimensional loom operating method comprising holding a group of warp rods disposed parallel to one another, holding a corresponding group of weft rods disposed in a plane held in a magazine, and filling the weft rods ejected from the magazine by a rod pusher between the corresponding warp rods, the improvement which comprises the step of:

sensing with a sensor when one of the rod groups held in the magazine reaches a preset limit for a magazine change and providing a signal indicative thereof; and ejecting a used-up magazine and feeding another magazine filled with a new set of rod groups to a rod filling position through the use of a control unit acting on the signal from the sensor.

2. A continuous rod-type three-dimensional loom operating method comprising holding a group of warp rods disposed parallel to one another, holding a corresponding group of weft rods disposed in a plane held in a magazine, and filling the weft rods ejected from the magazine by a rod pusher between the corresponding warp rods, the improvement which comprises the step of:

sensing with a sensor when one of the rod groups held in the magazine reaches a preset limit for a magazine change and providing a signal indicative thereof;

stopping the rod pusher and starting a filling of weft rods from an opposite direction by means of a magazine and a rod pusher disposed on an opposite side of the group of warp rods through the use of a control unit acting on the signal from the sensor; and replacing a used-up magazine with another magazine filled with a new set of rod groups while the filling of weft rods from the opposite direction is being carried out.

3. The improvement according to any one of claims 1 to 2 which comprises:

pressing each of the weft rod groups disposed in a plane and contained in a rod magazine in a feeding direction thereof with a pressure plate and actuating the control unit on a signal from a sensor triggered by the pressure plate for the rod group that has reached the preset limit for a magazine change.

4. A rod-type three-dimensional loom comprising a holder to hold a multi-strand group of warp rods disposed parallel to one another, a rod magazine holding a corresponding group of weft rods disposed in a plane and a rod pusher to feed the weft rods successively from the magazine between the corresponding warp rods, the improvement which comprises:

a sensor to sense a point where one of the rods in the magazine reaches a preset limit for a magazine change and providing a signal indicative thereof;

an unloader to remove a used-up magazine, a feeder to supply another magazine filled with a new set of weft rod groups;

a magazine stand to move a magazine to a weft rod feeding position and to a delivery point on the unloader and feeder; and a control unit to control the automatic replacement of magazines by the magazine stand, unloader and feeder on the signal from the sensor.

5. A rod-type three-dimensional loom comprising a holder to hold a multi-strand group of warp rods disposed parallel to one another, a rod magazine holding a corresponding group of weft rods disposed in a plane and a rod pusher to feed the weft rods successively from the magazine between the corresponding warp rods, the improvement which comprises:

a plurality of rod feeders each comprising said rod magazine and rod pusher and another set of similar rod feeders disposed on both sides of the group of warp rods;

a sensor to sense a point where one of the rods in the magazine reaches a preset limit for a magazine change and providing a signal indicative thereof; and a control unit to switch the rod feeding operation from one set of rod feeders to the other set on an opposite side on the signal from said sensor.

6. The improvement according to claim 5 which comprises:

an unloader to remove a used-up magazine, a feeder to supply another magazine filled with a new set of weft rod groups, and a magazine stand to move a magazine to a weft rod feeding position and to a delivery point on the unloader and feeder; and a control unit to switch the rod feeders on the signal from the sensor which includes means for controlling an automatic replacement of magazines by the magazine stand, unloader and feeder.

7. The improvement according to any one of claims 4 to 6 which comprises:

a pressure plate to serve as a weight to press the weft rod outward is mounted on each rod group contained in the rod magazine, the pressure plate having a part to trigger the sensor when the preset limit for a magazine change is reached.

* * * * *